US006251223B1

(12) United States Patent
Kessler et al.

(10) Patent No.: US 6,251,223 B1
(45) Date of Patent: Jun. 26, 2001

(54) PROCESS FOR IMPROVING PRINTING PAPER

(75) Inventors: Hansjörg Kessler, Meerbusch; Dieter Horand, Niederkrüchten; Wolfram Friesen, Nettetal, all of (DE)

(73) Assignee: Stora Publication Paper AG, Düsseldorf (DE)

( * ) Notice: Subject to any disclaimer, the term of this patent is extended or adjusted under 35 U.S.C. 154(b) by 0 days.

(21) Appl. No.: 09/214,725

(22) PCT Filed: Jul. 8, 1997

(86) PCT No.: PCT/EP97/03597

§ 371 Date: Jan. 11, 1999

§ 102(e) Date: Jan. 11, 1999

(87) PCT Pub. No.: WO98/01622

PCT Pub. Date: Jan. 15, 1998

(30) Foreign Application Priority Data

Jul. 10, 1996 (DE) ..... 196 27 669

(51) Int. Cl.[7] ..... D21H 23/04; D21H 23/28

(52) U.S. Cl. ..... 162/125; 162/128; 162/164.1; 162/164.3; 162/164.6; 162/168.2; 162/168.3; 162/175; 162/178; 162/183; 162/127; 162/185; 162/186; 162/203

(58) Field of Search ..... 162/127, 128, 162/125, 183, 185, 186, 202, 203, 265, 266, 289, 300, 301, 302, 322, 336, 168.3, 164.1, 164.3, 164.6, 168.2

(56) References Cited

U.S. PATENT DOCUMENTS

| | | | | |
|---|---|---|---|---|
| 3,560,334 | * | 2/1971 | Arledter | 162/266 |
| 5,560,807 | * | 10/1996 | Hauser | 162/183 |
| 5,900,121 | * | 5/1999 | Lehleiter et al. | 162/332 |
| 5,958,189 | * | 9/1999 | Begemann et al. | 162/322 |

* cited by examiner

*Primary Examiner*—Peter Chin
(74) *Attorney, Agent, or Firm*—Cohen, Pontani Lieberman & Pavane

(57) ABSTRACT

A process for improving gravure and offset printability of coated and uncoated printing papers by increasing filler share in the paper on the top and bottom sides or in the outer layers of the paper web by using a retention agent, and providing the outerlayers of the fiber bearing liquid forming the paper web with additional retention agent before or during sheet formation on or between the wires of the paper making machine.

9 Claims, No Drawings

PROCESS FOR IMPROVING PRINTING PAPER

BACKGROUND OF THE INVENTION

1. Field of the Invention

The invention relates to a process for improving the gravure and offset printability of coated and uncoated printing papers by increasing the filler share in these papers on the top and bottom sides or in the outer layers of the paper web by the use of retention agents.

2. Discussion of the Prior Art

According to the prior art, so-called SC and LWC rotary printing papers, which must meet higher standards for printing results, are used for large print jobs. The term "SC papers" refers to rotary printing papers that contain up to 35% mineral filler and have high gloss and smoothness due to post-treatment in a super-calendar. The abbreviation "SC" stands for "super-calendared."

The term "LWC papers" refers to rotary printing papers that contain up to 15% mineral filler by mass and are provided inside or outside the paper-making machine with a pigmented surface coating, the coat, on both sides. After being coated, these printing papers are also treated with a super-calendar to attain high gloss and smoothness. The abbreviation LWC stands for "light-weight coated."

SC and LWC printing papers were initially produced on so-called endless-wire paper-making machines. These papers have the disadvantage known as "two-sidedness," i.e., due to one-sided dewatering on the wire, filler and fine material were washed out on the bottom side, so that the wire side of the paper was always rougher than the top side, and the paper web, seen in the Z-direction, had an irregular or skewed ash cross-section. Varying filler or ash contents inevitably lead to irregular printing results on the top and wire sides, so that such papers no longer satisfy modern requirements.

To avoid such disadvantages, wire devices with two-sided dewatering, known as hybrid formers, were therefore developed.

The German publication "Paper Fabrication Weekly" ["Wochenblatt für Papierfabrikation"], 1987, pages 461 through 478, provides an overview of modern sheet formation systems, consisting of flow box and sheet formation devices. Section 3, of this publication in particular, describes hybrid and twin-wire formers and their advantages compared with the classic endless-wire models.

In addition, the "Paper Fabrication Weekly" ["Wochenblatt für Papierfabrikation"], 1987, pages 662 through 667, describes multi-layer printing papers formed by means of multi-layer flow box devices and twin-wire formers. The same reference also discloses that it is possible to deliberately influence the distribution of filler in the outer layers of the paper web by adding filler to the outer channels of a multi-layer flow box.

Finally, German reference DE 42 37 309 discloses a process for producing a fibrous web, wherein a fiber-bearing liquid is evenly distributed, with the help of a flow box, on a wire or between two wires. To avoid fluctuations in the area weight cross-section, the retention of fiber-bearing liquid on the wire is sectionally influenced by the sectional dosing of retention agent in the flow box.

Modern twin-wire formers for producing SC and LWC papers are operated at working speeds of up to 1,500 m/min. Known SC papers produced with these devices have filler shares of up to 34% with very even distribution in the Z-direction. These SC printing papers currently constitute the highest paper class with respect to printability.

Continued increases in production speed, including in twin-wire formers, are urgently needed to increase profitability. However, this raises the problem of intensifying the dewatering of the fiber-bearing liquid between the two wires along a given distance. This is done by applying a higher vacuum to individual dewatering elements, which engage with the upper and lower wires. However, the increased water extraction and the higher flow speed that accompanies it inevitably create the disadvantage that more filler is applied in the Z-direction of the formed wet paper web. This results in filler impoverishment on the outer sides, and thus in a substantial deterioration in printability.

German reference DE 37 20 618 A1 attempts to offer an improvement by providing a process to improve the filler retention. The fiber-bearing liquid is supplied to a multi-layer flow box after first being divided by fractionation into a long-fiber portion and a short-fiber portion, which also contains all fillers. The long-fiber portion is subjected to additional fibrillation by beating and, after dilution and the simultaneous addition of retention agent, is supplied to the outer channels of a multi-layer flow box in front of, the pulp pump by means of the pulp pump. The portion containing short fibers and filler is supplied to the middle or inner channels of the multi-layer flow box. Upon subsequent dewatering, the long fibrillated fibers of a fine network are formed between the two wires of a twin-wire former. The fine network, as a filter layer, serves to retain the filler and fine material of the middle layer and results in an increase in filler.

It is disadvantageous in this process that the anchoring of the outer layer containing the long fibers is impaired by the increased filler and fine material content of the middle layer, so that the Z-strength is decreased. The paper tends to split when stressed in the Z-direction, e.g., during offset printing.

SUMMARY AND DESCRIPTION OF THE INVENTION

Accordingly, it is an object of the present invention to solve this problem of the prior art.

Pursuant to this object, one aspect of the present invention resides in a process for improving the gravure and offset printability of coated and uncoated printing papers by increasing the filler share in these papers on their top and bottom sides or in the outer layers of the paper web by the use of retention agents in which before or during sheet formation on the wires or between the wires of a paper-making machine, the outer layers of the fiber-bearing liquid forming the paper web are provided with additional retention agent.

The use of retention agents in producing paper has long been known and permits good filler and fibrous material retention on the sheet formation wire. Such retention agents are generally added to the fiber-bearing liquid before a mixing organ, e.g., the flow box pump, so that the fiber-bearing liquid is mixed evenly with the retention agent before emerging from the lip or nozzle of the flow box. Starting from the recognition that the inner layer of a paper web, due to the filter effect, already has sufficient retention for filler and fine materials, the present inventors realized that an enrichment of the retention agent in the outer layer is advantageous. The problem was thus solved by the additional dosing of retention agent.

Depending on the paper type, retention agents with cationic or anionic charges of various strengths can be used.

Although strongly charged retention agents improve the retention of filler and fine materials, such agents can, depending on their reaction time with the fiber-bearing liquid, form large fiber flocks, which negatively affect the fibrous formation in the formed paper sheet. This is known as a cloudy look-through.

However, it has been recognized that this negative effect can be suppressed by shortening the reaction time. Therefore, in an advantageous embodiment of the process according to the invention, a retention agent having a high cationic charge is used.

In addition, so-called dual retention systems are known. In these, the fiber-bearing liquid is provided with a first retention agent, e.g., a cationic agent, before the flow box, and mixed well. Subsequently, but still before the flow box, a second retention agent, in this case, an anionic agent, is added to the fiber-bearing liquid and mixed. The retention agents with opposite charges react with each other and with the fibers, the filler and the fine materials of the fiber-bearing liquid, and contribute to substantially better overall retention. In a further advantageous embodiment of the invention, the charge of the additional retention agent is opposite to that of the retention agent already present in the fiber-bearing liquid supplied to the flow box.

The following known retention agents can be added individually or in mixtures: polyethylene imines, polyacrylamides, epichlorhydrine resins and/or polyvinylamines.

Cationic hydrocolloids can also be advantageously used. These can consist of cationic starch or cationized guar. When cationic starch or guar is used, it is also possible to influence the charge and network formation via the degree of cationization and the chain length of the starch or guar.

In an advantageous process for providing the outer layers of the fiber-bearing liquid forming the paper web with additional retention agent, the retention agent is injected into a flow box downstream from the turbulence generator across the width of the fiber-bearing liquid flow in its upper or lower boundary layer. Such a one-layer flow box is called a step diffusor.

In a further advantageous embodiment of the process, the additional retention agent is injected, in a flow box with a multi-layer device, into the chamber for the top and bottom layers.

In yet a further advantageous embodiment of the inventive process, when a twin-wire former with a gap device is used, the additional retention agent is sprayed onto the wire gauze in the returning drum of the upper and lower wires.

A flow box to implement the process according to the invention has, at a right angle to the flow direction of the fiber-bearing liquid, devices for the even dosing of the additional retention agent. In the simplest case, these devices comprise borings arranged in the flow box in a line that extends at a right angle to the flow direction, which borings have inflow devices for the retention agent.

A further device, especially for a multi-layer flow box with three layers and step diffusors, has borings for injecting retention agent that are located upstream from the respective step diffusors of the top and bottom layers.

What is claimed is:

1. A process for improving gravure and offset printability of coated and uncoated printing papers, comprising the steps of: increasing filler share in the paper on top and bottom sides or in outer layers of a paper web using a retention agent; and, providing outer layers of fiber-bearing liquid forming the paper web with additional retention agent one of before and during sheet formation one of on and between wires of a paper-making machine, the step of providing additional retention agent including injecting the additional retention agent in a flow box downstream from a turbulence generator, across a width of a suspension flow in top and bottom boundary layers of the suspension flow.

2. A process as defined in claim 1, wherein the step of providing additional retention agent includes providing a retention agent having a high positive charge.

3. A process as defined in claim 1, wherein the additional retention agent has a charge opposite to that of the retention agent already present in the fiber-bearing liquid.

4. A process as defined in claim 1, wherein the additional retention agent consists of at least one of the group consisting of polyethylene imines, polyacrylamides, epichlorhydrine resins, and polyvinylamines.

5. A process as defined in claim 1, wherein the additional retention agent consists of cationic hydrocolloids.

6. A process as defined in claim 1, wherein the additional retention agent consists of cationic starch.

7. A process as defined in claim 1, wherein the additional retention agent consists of cationic guar.

8. A process as defined in claim 1, wherein the step of providing additional retention agent includes injecting the additional retention agent in a flow box with a multi-layer device, into the top and bottom layers.

9. A process for improving gravure and offset printability of coated and uncoated printing papers, comprising the steps of: increasing filler share in the paper on top and bottom sides or in outer layers of a paper web using a retention agent; and, providing outer layers of fiber-bearing liquid forming the paper web with additional retention agent one of before and during sheet formation one of on and between wires of a paper-making machine, the step of providing additional retention agent including spraying the additional retention agent onto a wire gauze in a twin-wire former in a returning drum of top and bottom wires downstream of a turbulence generator.

* * * * *